US010709183B2

(12) United States Patent
Kim et al.

(10) Patent No.: US 10,709,183 B2
(45) Date of Patent: Jul. 14, 2020

(54) METHOD OF MANUFACTURING MULTIPURPOSE SAFETY GLOVE AND MULTIPURPOSE SAFETY GLOVE MANUFACTURED THEREBY

(71) Applicants: Young Min Kim, Busan (KR); SEMYUNG INC., Daegu (KR)

(72) Inventors: Young Min Kim, Busan (KR); Seong Dong Lee, Daegu (KR)

(73) Assignees: SEMYUNG INC., Daegu (KR); Young Min Kim, Busan (KR)

( * ) Notice: Subject to any disclaimer, the term of this patent is extended or adjusted under 35 U.S.C. 154(b) by 312 days.

(21) Appl. No.: 15/688,563

(22) Filed: Aug. 28, 2017

(65) Prior Publication Data

US 2018/0055114 A1 Mar. 1, 2018

(30) Foreign Application Priority Data

Aug. 29, 2016 (KR) ..... 10-2016-0110139

(51) Int. Cl.
*A41D 19/015* (2006.01)
*D04B 1/28* (2006.01)
(Continued)

(52) U.S. Cl.
CPC ..... *A41D 19/01576* (2013.01); *A41D 19/015* (2013.01); *D04B 1/28* (2013.01);
(Continued)

(58) Field of Classification Search
CPC .. A41D 19/00; A41D 19/015; A41D 19/0013; A41D 19/0017; A41D 19/01505; A41D 19/001; A41D 19/0062; A41D 19/0065; A41D 19/0068; A41D 19/01547; A41D 19/01576; A41D 19/04;
(Continued)

(56) References Cited

U.S. PATENT DOCUMENTS 474,929 A * 5/1892 Tabor et al. ..... A41D 19/00 2/163
747,730 A * 12/1903 Kommer ..... A41D 19/00 2/163
(Continued)

FOREIGN PATENT DOCUMENTS

JP 2002088542 3/2002
KR 10-1638483 7/1916
(Continued)

*Primary Examiner* — Robert H Muromoto, Jr.
(74) *Attorney, Agent, or Firm* — Norton Rose Fulbright US LLP

(57) ABSTRACT

The present disclosure relates to a method of manufacturing a multipurpose safety glove and a multipurpose safety glove manufactured thereby, and, more particularly, the present disclosure relates to a method of manufacturing a multipurpose safety glove and a multipurpose safety glove manufactured thereby in which a breakaway portion is not easily broken when general work is performed, so that a worker may be able to easily perform work tasks while wearing the safety glove. At the same time, safety requirements for the glove to be easily broken away from the hand in the case of danger are met, whereby a worker's body can be protected while maintaining working efficiency.

8 Claims, 2 Drawing Sheets

(51) Int. Cl.
*D06M 11/05* (2006.01)
*A41D 13/00* (2006.01)

(52) U.S. Cl.
CPC ..... *D06M 11/05* (2013.01); *A41D 2300/50* (2013.01); *A41D 2400/70* (2013.01); *A41D 2500/10* (2013.01)

(58) Field of Classification Search
CPC ..... A41D 2400/32; A41D 2500/10; A41D 19/0055; D04B 1/28; D04B 1/14; D04B 1/16; D04B 7/34; B29D 99/0067
See application file for complete search history.

(56) References Cited

U.S. PATENT DOCUMENTS 1,265,124 A * 5/1918 Shumaker ..... A41D 19/0062 2/168
1,358,824 A * 11/1920 Burden ..... A41D 19/015 2/163
1,620,434 A * 3/1927 Burden ..... A41D 19/015 2/163
3,608,093 A * 9/1971 Kirby ..... A41D 19/0017 2/163
4,045,824 A * 9/1977 Weppler ..... A41D 19/0013 2/163
4,131,952 A * 1/1979 Brenning, Jr. ..... A41D 19/015 2/124
4,507,807 A * 4/1985 Karkanen ..... A41D 19/0055 2/161.8
4,651,350 A * 3/1987 Dawiedczyk ..... A41D 19/0017 2/158
4,781,178 A * 11/1988 Gordon ..... A61F 5/0118 602/22
5,228,142 A * 7/1993 Yoswein-McGreen ..... A61F 13/10 2/159
7,908,891 B2 * 3/2011 Thompson ..... A41D 19/0065 66/174
8,458,817 B1 * 6/2013 Babb ..... A41D 19/0013 2/159
9,072,326 B2 * 7/2015 Becker ..... A41D 19/01505
9,554,603 B2 * 1/2017 McCourt ..... A41D 19/01576
10,179,186 B2 * 1/2019 Moreland ..... A61L 15/44
10,231,497 B2 * 3/2019 Oh ..... A41D 19/0006
2001/0049838 A1 * 12/2001 Fitz ..... A41D 19/0075 2/21
2006/0156453 A1 * 7/2006 Lee ..... A41D 19/0017 2/163
2014/0237701 A1 * 8/2014 Thompson ..... A41D 19/001 2/164
2017/0258155 A1 * 9/2017 Grigg ..... A41D 19/0051

FOREIGN PATENT DOCUMENTS

KR 1998-068520 12/1998
KR 10-0811863 3/2008
KR 10-2013-0099047 5/2013
KR 10-2016-0172627 11/2016
WO WO 2005/093139 10/2005

* cited by examiner

METHOD OF MANUFACTURING MULTIPURPOSE SAFETY GLOVE AND MULTIPURPOSE SAFETY GLOVE MANUFACTURED THEREBY

CROSS-REFERENCE TO RELATED APPLICATION

This application claims priority to and the benefit of Korean Patent Application No. 10-2016-0110139, filed on Aug. 29, 2016, the disclosure of which is incorporated herein by reference in its entirety.

BACKGROUND

1. Field of the Invention

The present disclosure relates to a method of manufacturing a multipurpose safety glove and a multipurpose safety glove manufactured thereby, and, more particularly, the present disclosure relates to a method of manufacturing a multipurpose safety glove and a multipurpose safety glove manufactured thereby in which a breakaway portion is not easily broken when general work is performed, so that a worker may be able to easily perform work tasks while wearing the safety glove. At the same time, safety requirements for the glove to be easily broken away from the hand in the case of danger are met, whereby a worker's body can be protected while maintaining working efficiency.

In addition, the present disclosure relates to a method of manufacturing a multipurpose safety glove and a multipurpose safety glove manufactured by the method that can be manufactured of various materials using various kinds of yarns, rather than a limited number of types of yarns, so that manufacturing costs can be decreased, and the method of manufacturing a multipurpose safety glove and the multipurpose safety glove manufactured by the method can be widely applied to various fields, because there is no limitation in the manufacturing method and the incidence of defects in the manufacturing process is remarkably low, resulting in excellent productivity.

2. Discussion of Related Art

Safety gloves for industrial work are mainly classified as welding gloves, heat-resistant gloves, cut-resistant gloves, and chemical-resistant gloves. Heat-resistant gloves are gloves that protect workers' hands from heat at high temperatures, cut-resistant gloves are gloves that protect workers' hands from sharp objects in work sites, and chemical-resistant gloves are gloves that protect workers' hands from chemicals. Such conventional work gloves are stipulated not to be worn when dealing with machinery in which fingers may be caught, such as a pressing device for pressing a workpiece with a strong pressure or a device for processing a workpiece by rotating and the like. This is because there is a concern that worker's hands may be caught in mechanical devices due to worker carelessness or malfunctioning of mechanical devices when dealing with the above machinery. Even if only the fingertips of the work gloves are slightly caught in machinary while the work gloves are worn on hands, the hands cannot be pulled out of the machine due to the gloves, so that the entire hand may become entangled in, or the arms may become severely get entangled in, machinary, causing workplace accidents.

However, in spite of the above reasons, as a result of prohibiting the wearing of gloves, work efficiency and worker comfort are decreased, and secondary damage such as occupational diseases caused by exposure to toxic substances occur over a long period of work. Therefore, most workers carry out work with gloves on their hands, and, as a result, many workers are exposed to workplace accidents unexpectedly. Therefore, even if the work gloves are worn on the hands when dealing with industrial machinary, it is urgently required to develop a work glove capable of preventing the occurrence of such workplace accidents in advance.

Korean Patent Registration No. 10-0811863 discloses a glove having a breakaway portion formed by being thinly knitted at a certain location in each finger portion, the finger portion breaking at the moment the finger portion gets entangled in the machine, so that it is possible to prevent workplace accidents in which worker's fingers may be entangled in machinery.

Conventional gloves, however, have some problems that, 1) since only the breakaway portion is knitted thinly, the breakaway portion is easily broken in the course of general work, as well as in dangerous situations, and ease of operations are decreased, 2) it is difficult to satisfy the ease of breaking and ease of operations simultaneously, which can be easily broken at a dangerous moment, 3) in the case of knitting a breakaway portion as in the prior art, since the breakaway portion is already broken at the time of the process, the incidence ratio of the defective article is remarkably high, whereby productivity is decreased, 4) an application field is narrow due to limitations of a manufacturing method, and 5) a yarn that can be used is limited.

SUMMARY OF THE INVENTION

An object of the present disclosure is to provide a method of manufacturing a multipurpose safety glove and a multipurpose safety glove manufactured by the method in which a breakaway portion is not easily broken when general work is performed, so that a worker may be able to easily perform work tasks while wearing the safety glove, while, at the same time, requirements for ease of breaking and safety by breaking easily in the case of danger.

In addition, another object of the present disclosure is to provide a method of manufacturing a multipurpose safety glove and a multipurpose safety glove manufactured by the method that can be manufactured using various kinds of yarns rather than being limited in terms of types of yarns, so can be versatile, and can be widely applied to a field of work where oil may be generated in large amounts, to a field requiring heat resistance, or to a field of perforation resistance, etc., and, in addition, the incidence of defects in the manufacturing process may be remarkably low, resulting in excellent productivity.

In order to solve the above-mentioned problems, the present disclosure provides a method of manufacturing a multipurpose safety glove including a body portion, a finger portion, and a breakaway portion that connects the body portion to the finger portion and can be separated by force pulling from the outside. The method may manufacture the breakaway portion by: twisting and weaving a first yarn insoluble in water and a second yarn containing a water-soluble polymer; and eluting a portion or all of the water-soluble polymer by treating the twisted water-soluble polymer with water.

In an exemplary embodiment of the present disclosure, an average fineness (A) of a fiber forming the body portion and the finger portion, and a average fineness (B) of the first yarn satisfy the following Formula 1.

$$30 \leq A/B \leq 70 \quad \text{Formula 1}$$

In a exemplary embodiment of the present disclosure, the water-soluble polymer comprises one selected from among polyvinyl alcohol (PVA), water-soluble acrylic polymer, polyethyleneimine (PEI), and water-soluble polyester.

In a exemplary embodiment of the present disclosure, the water soluble polymer has a melting point of 40 to 100° C. in water and the treatment with water in the eluting of the water-soluble polymer is performed at a water temperature of 40 to 100° C.

In a exemplary embodiment of the present disclosure, the first yarn comprises at least one selected from among nylon, spandex, polyamide, ultra-high molecular weight polyethylene (UHMWPE), polyolefin fiber, and polyester.

In a exemplary embodiment of the present disclosure, in the twisting of the first yarn and the second yarn, the first yarn and the water-soluble polymer are mixed in a weight ratio of 1:2 to 4.

In a exemplary embodiment of the present disclosure, further including, coating a portion or all of the breakaway portion, simultaneously with or after eluting the water-soluble polymer.

In addition, in order to solve the above-mentioned problems, the present disclosure provides a multipurpose safety glove including: a body portion; a finger portion; and a breakaway portion that connects the body portion with the finger portion and can be separated by a force pulled from the outside, wherein a tensile strength of the breakaway portion is 20 to 40 N when measured according to KS K 0520 standard.

In a exemplary embodiment of the present disclosure, the breakaway portion includes the water-soluble polymer 10 weight % (wt %) or less.

In a exemplary embodiment of the present disclosure, an average fineness (A) of a fiber forming the body portion and the finger portion, and an average fineness (B) of the first yarn satisfy a following Formula:

$$30 \leq A/B \leq 70$$

According to the method of manufacturing a multipurpose safety glove and a multipurpose safety glove manufactured thereby according to the present disclosure, a breakaway portion is not easily broken when general work is performed, so that the worker may be able to easily perform work tasks while wearing the multipurpose safety glove, and, at the same time, ease of breaking and safety by breaking easily in case of danger, thereby the worker's body can be protected while maintaining the working efficiency.

In addition, the multipurpose safety glove can be manufactured of various materials using various kinds of yarns, rather than a limited number of types of yarns, so that manufacturing costs can be decreased, and the method of manufacturing a multipurpose safety glove and the multipurpose safety glove manufactured by the method can be widely applied to various fields of work in which oil may be generated in large amounts, a field requiring heat resistance, or to a field of perforation resistance, or the like, whereby the multipurpose safety glove can be usefully used to prevent industrial accidents in various industrial fields. Moreover, since the incidence of defects is remarkably low in the manufacturing process, productivity is excellent.

DETAILED DESCRIPTION OF EXEMPLARY EMBODIMENTS

Figure 1:
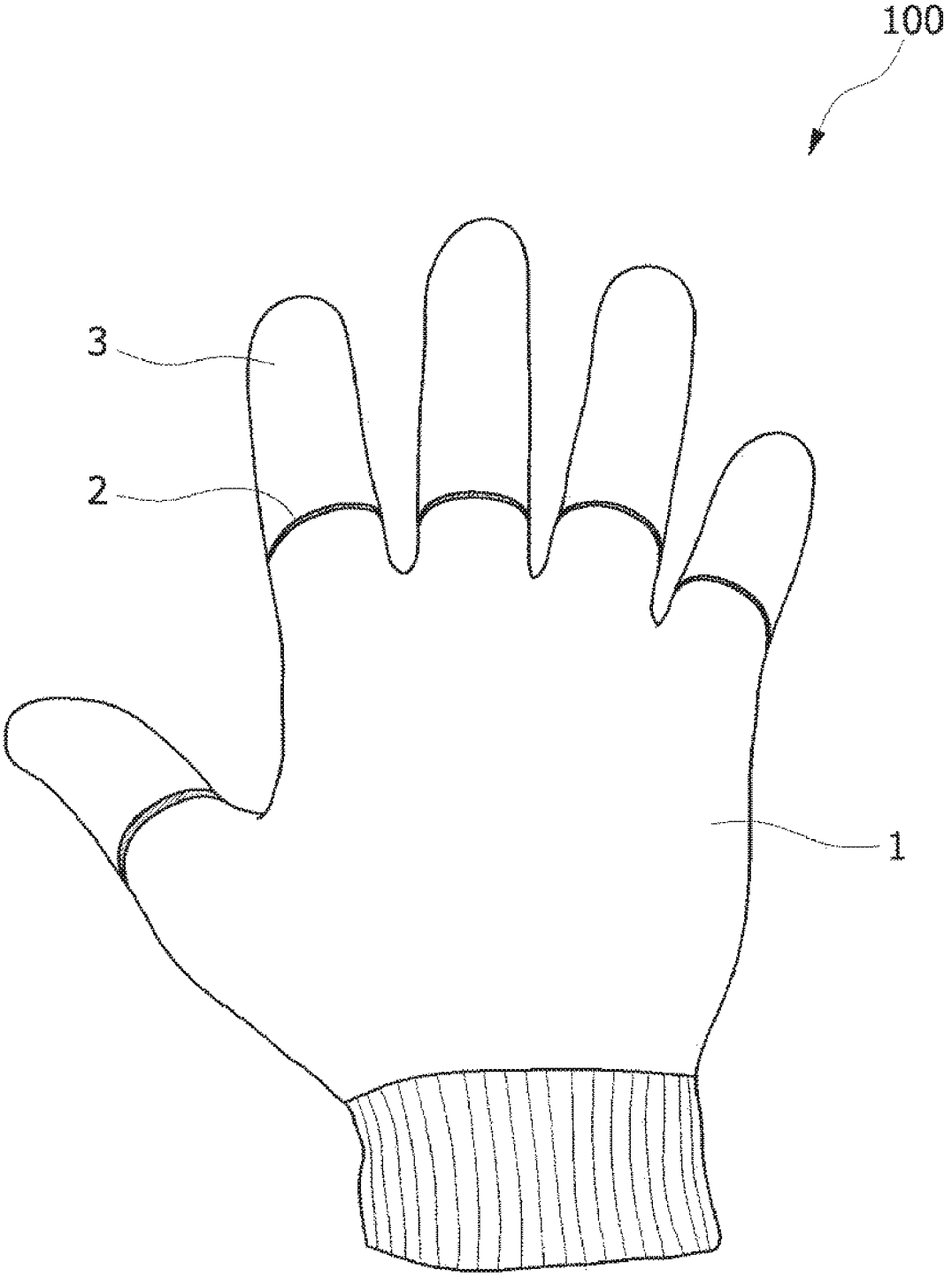
FIG. 1 is a schematic view of a multipurpose safety glove according to an embodiment of the present disclosure.

Hereinafter, embodiments of the present disclosure will be described in detail with reference to accompanying drawings so that one of ordinary skill in the art could easily carry out. It should be understood, however, that the embodiments are not intended to limit the scope of the present disclosure, and should be construed as merely being provided to facilitate understanding of the present disclosure.

A conventional glove having a breakaway portion is formed by thinly knitting the breakaway portion, the breakaway portion is easily broken not only at the time of danger but also during the general work, there are problems that ease of operations and ease of breaking, in which the glove can be easily broken in a hazardous moment are decreased and it is difficult to satisfy both ease of operations and ease of breaking.

Further, in the case of forming the breakaway portion as in the prior art, there may be a problem in which the breakaway portion is already broken in the manufacturing process, so that the incidence ratio of the defective article is remarkably high and productivity is low. Moreover, the incidence ratio of the defective article may be remarkably high and productivity may be low. The problem is that the application field is narrow due to limitations in the manufacturing method, and there is a problem in that the application field is narrow due to limitations in which the manufacturing method and yarn which can be used are limited.

Accordingly, the present disclosure provides a method of manufacturing a multipurpose safety glove comprising a body portion, a finger portion, and a breakaway portion connecting the body portion with the finger portion and which can be separated by force pulling from the outside, where manufacturing the breakaway portion comprises: (1) twisting and weaving a first yarn insoluble in water and a second yarn containing a water-soluble polymer; and (2) eluting a part or all of the water-soluble polymer by treating the twisted water-soluble polymer with water, thereby solving the above-mentioned problems. Accordingly, a worker can easily perform work while wearing the glove, and the breakaway portion can be broken in the event of danger, thereby preventing breaking and raising of the body portion such as a finger or the like, and exposure to harmful substances can be prevented.

Further, in the manufacturing the breakaway portion of the present disclosure, not only the first yarn, but also the second yarn including a water-soluble polymer which is eluted all or a part, can be woven with a thicker fiber due to twisting, and therefore, it is possible to prevent a phenomenon such as a machine jam or a machine dropout that may occur when the breakaway portion is manufactured using only thin fibers. As a result, the incidence ratio of defective articles can be significantly decreased, which can increase productivity.

In addition, because of the elution step, a multipurpose safety glove can be manufactured from various materials using a variety of yarns, so that manufacturing costs can be easily lowered, the multipurpose safety glove can be widely applied to a field of work in which oil may be generated in large amounts, a field requiring heat resistance, or to a field of perforation resistance, by performing the elution step to overcome the limitations of the manufacturing method.

In addition, various yarns can be produced using various types of knitting machines, although knitting machines of various gauges (G) can be used without limitation, as long as they can manufacture a work glove, more preferably, a middle gauge (7 to 10 G) or a high gauge (12 to 18 G) knitting machine can be used. That is, it is possible to manufacture a safety glove of various materials by using various yarns and various types of knitting machines, thereby increasing productivity in the manufacturing of a multipurpose safety glove and the multipurpose safety glove can be widely applied in various fields of work.

More particularly, FIG. 1 schematically illustrates a multipurpose safety glove according to an exemplary embodiment of the present disclosure. As shown in the drawing, the multipurpose safety glove 100 of the present disclosure includes a body portion 1, finger portions 3 communicating with the body portion 1, and breakaway portions 2 formed between the body portion 1 and the finger portions 3, respectively.

Figure 2:
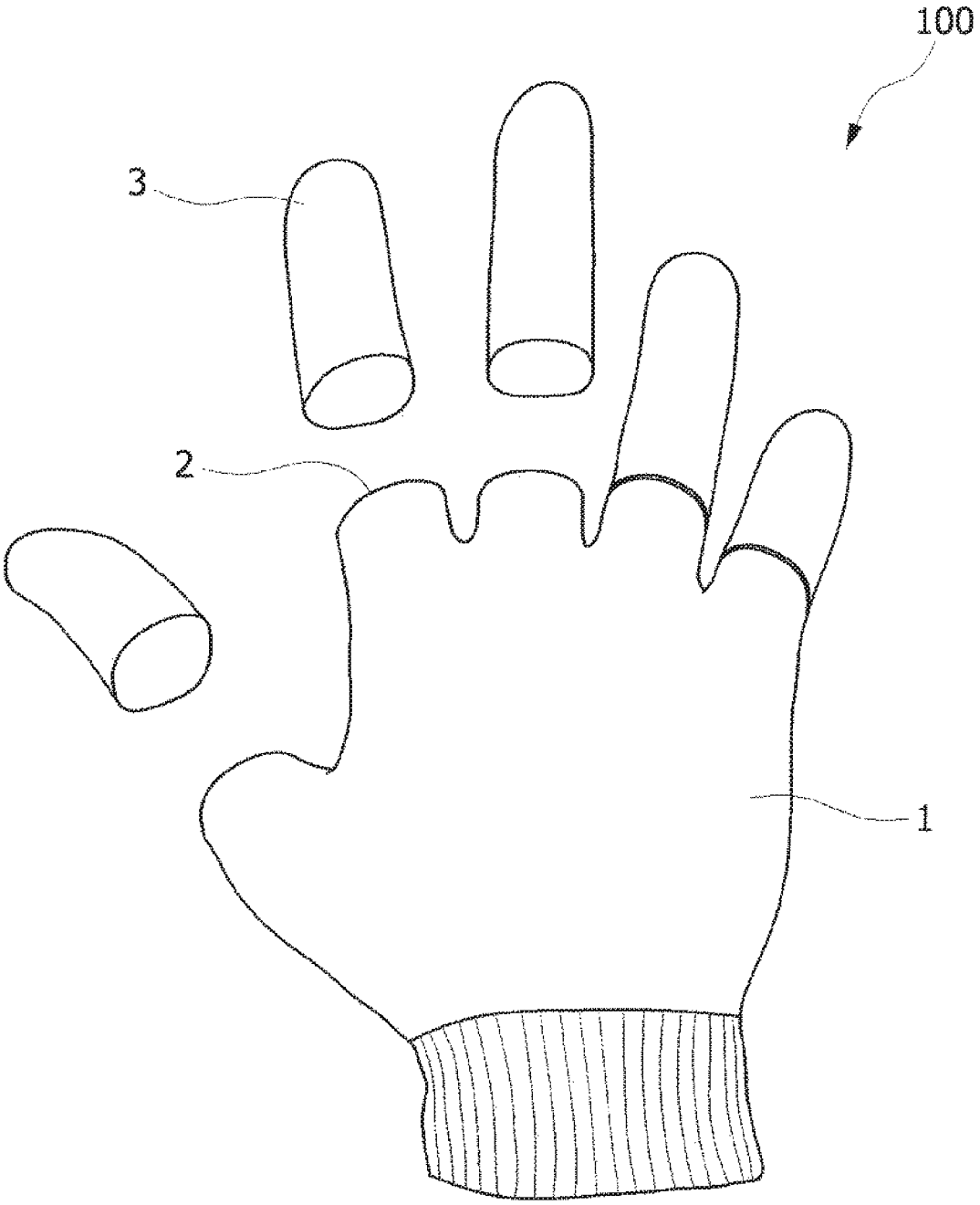
FIG. 2 is a schematic view of a multipurpose safety glove partially broken by external pulling force according to an embodiment of the present disclosure.

Further, FIG. 2 is a perspective view of the multipurpose safety glove in which specific finger portions of the finger portions 3 are separated from the body portion 1, in response to the breakaway portions 2 corresponding thereto being broken by force pulling from the outside, according to an exemplary embodiment of the present disclosure. As shown in the drawings, the multipurpose safety glove 100 according to the present disclosure is constructed in such a manner that when the breakaway portions 2 connecting the body portion 1 and the finger portions 3 are broken, the finger portions 3 are separated from the body portion 1.

First, the body portion 1 will be described.

The body portion (1) means the part of the glove which can protect the back of the hand, palm and a portion of the wrist. Generally, when weaving the body portion 1, a fiber-forming component, such as cotton or water-insoluble polystyrene, which can be used for safety glove, work glove, and the like, can be used without limitation when such a fiber-forming component can be contained in composite fiber. Preferably, one or more yarns selected from among nylon, spandex, polyamide, ultra-high molecular weight polyethylene (UHMWPE), polyolefin-based fibers and polyester may be used. Particularly, the polyamide-based synthetic resin may be nylon 6, nylon 6•6, nylon 6•10 or the like, and a polyamide-based synthetic resin having added functionality may also be used. However, the fiber-forming component may be modified to realize a fiber having desired physical properties, and is not limited to a specific example.

Next, the finger portions 3 communicating with the body portion 1 will be described.

The finger portions 3 are portions of the glove that accommodate the finger to protect the finger.

When weaving the finger portions 3, the same fiber forming component as used for the body 1, as described above, can be used.

Next, the breakaway portions 2 connecting the body portion 1 and the finger portions 3 will be described.

In general, the breakaway portions 2 may be located at portions where the body portion 1 and the finger portions 3 are connected, and may located in any portion of fingers without limitations in positions. Preferably the breakaway portions 2 may respectively be located between the first joint (or knuckle) of the finger where the finger and palm abut and the second joint of the finger.

The work glove of the present disclosure having the breakaway portions 2 as described above is designed to facilitate working by protecting the hand of a worker, and is characterized by being able to be worn without fear of causing workplace accidents even in the work of dealing with a machine in which the wearing of the glove is restricted. That is, the breakaway portions 2 can be broken by force pulling from the outside, and the breakaway portions 2 corresponding to specific portions of fingers can be completely separated from the body portion 1 of the glove. It is possible to prevent a workplace accident in which the entire part of the hand is brought into a machine and is squeezed or cut off, due to the finger portion 3 of the glove being entangled in the rotating machine or the like. In this way, it is possible to completely solve the safety problem such as workplace accidents and the like, in which case the entire part of the hand with the glove is drawn into the machine even if the worker attempts to quickly pull the hand out of the machine when the finger portion is entangled in the machine.

Specifically, with respect to the manufacturing of the breakaway portions 2, the operation (1) of twisting and weaving a first yarn insoluble in water and a second yarn containing a water-soluble polymer of step is described.

First, the water-insoluble first yarn which is used in the manufacturing of the breakaway portions 2 by being twisted with the first yarn will be described.

In general, as the first yarn, a fiber-forming component, such as cotton or water-insoluble polystyrene which can be used for safety glove, work glove, and the like, can be used without limitation when the fiber-forming component can be contained in the composite fiber. Preferably, one or more yarns selected from among nylon, spandex, polyamide, ultra-high molecular weight polyethylene (UHMWPE), polyolefin-based fibers and polyester can be used. Particularly, the polyamide-based synthetic resin may be nylon 6, nylon 6•6, nylon 6•10 or the like, and a polyamide-based synthetic resin having added functionality may also be used. However, the fiber-forming component may be modified to realize a fiber having desired physical properties, and is not limited to a specific example.

The first yarn, which is insoluble in water, can remain in the woven state without being eluted during the step of eluting the water-soluble polymer of the breakaway portions 2. In addition, elastic fiber yarns such as nylon, spandex, polyolefin-based fibers or polyester have high elongation and excellent elastic recovery, so, when the glove is woven with such fibers, the perforation resistance is enhanced to the outside of the glove, and there is an advantage of having both of perforation resistance and elasticity to the inside or the glove. In addition, ultra-high molecular weight polyethylene (UHMWPE) and polyamide-based fibers can be used, and thus it is possible to manufacture work glove having safety.

Particularly, the following Tables 1 and 3 show examples of the present disclosure and the effects of ease of operation, ease of breaking, fraction defective and the like. As represented in Tables 1 and 3 below, nylon, spandex, polyamide, ultra-high molecular weight polyethylene (UHMWPE), polyolefin-based fibers or polyester is used as the first yarn. When the breakaway portions 2 of the glove of the present disclosure are woven by twisting the first yarn and the second yarn together by adding the water-soluble polymer thereto, it is possible to obtain an excellent glove satisfying both ease of operation and ease of breaking.

On the other hand, an average fineness (A) of the fiber forming the body portion 1 and the finger portion 3, and an average fineness (B) of the first yarn can satisfy following Formula 1.

$$30 \leq A/B \leq 70 \quad \text{Formula 1}$$

Although the A/B may be in the range of 30 to 70 as described above, the A/B may preferably be in the range of 35 to 65, and more preferably in the range of 40 to 60.

When the glove is woven so that the average fineness A of the fibers forming the body portion 1 and the finger portion 3 and the average fineness B of the first yarn satisfy the above Formula 1, the body part 1 and the finger part 3 can be provided with ease of operation so that the worker wears the glove at the work site and can easily carry out the work, and it is possible to provide safety so as to protect the worker's body from harmful substances, machines, devices, and the like. In addition, when an accident such as the insertion of a glove into a rotating machine occurs at a work site at the time of work, the breakaway portion 2 corresponding to a certain portion of the finger can be completely separated from the body portion 1 of the glove by the force pulling from the outside. That is, it is possible to obtain a glove having an excellent ease of breaking, when an accident occurs at a work site, the breakaway portion 2 can be easily broken, and the breakaway portion 2 can be firmly formed by being joined together with the water-soluble polymer during the glove manufacturing process, therefore the incidence of defects in which the breakaway portion 2 is broken in the production process can be reduced.

When A/B in the above Formula 1 is less than 30, when the fineness of both A and B is high, the ease of breaking of the breakaway portion 2 is decreased, there is a problem in that the breakaway portion 2 may not be broken when an accident such as glove pinching occurs at a work site, and twisting in the breakaway portion 2 may not be easily carried out. When the fineness of both A and B is low, fraction defective is increased because there is a possibility of being easily separated from the yarn introduction apparatus during the weaving process, and there is a problem that safety and ease of operation are decreased because glove is not robust as a whole. Also, when A/B in Formula 1 exceeds 70, since the difference in the fineness of the two fibers becomes too large and the thickness of the fibers forming the body portion 1 and the finger portion 3 becomes too thick, it becomes difficult to carry out the work while wearing the glove. There is a problem in that the ease of operation is decreased.

Next, the water-soluble polymer contained in the second yarn used in the manufacturing of the breakaway portion 2 will be described.

As the above water-soluble polymer, any fiber-forming polymer component that is water soluble and is easily elutable can be used without limitation when the fiber-forming component is typically contained in the composite fiber. According to a exemplary embodiment of the present disclosure, the water-soluble polymer may be any one selected from among polyvinyl alcohol (PVA), water-soluble acrylic (Acryl) polymer, polyethyleneimine (PEI) and water-soluble polyester, more preferably polyvinyl alcohol (PVA).

Particularly, the polyester component may be at least one selected from the group consisting of polyethylene terephthalate, polytrimethylene terephthalate, polybutylene terephthalate, polyhexylene terephthalate, polyethylene naphthalate, polybutylene naphthalate, polyethylene-1,2-bis (phenoxy) ethane-4,4'-dicarboxylate, polyethylene isophthalate/nephthalate copolymer, polybutylene terephthalate/isophthalate copolymer, and polybutylene terephthalate/decane-dicarboxylate copolymer.

Further, the acrylic component may be polyacrylonitrile, in addition to the acrylonitrile monomers, as non-limiting examples, it may be a modified acrylic component that further includes monomers, such as fluoroalkyl methacrylate or fluoroalkyl acrylate, vinyl chloride, and vinylidene chloride.

The water-soluble polymer is twisted together with the first yarn in the manufacturing process of the breakaway portion 2 to form thicker composite fibers, there arises no problem such as machine jamming or machine dropout that may occur when manufacturing the breakaway portion 2 with thin threads. Accordingly, in the manufacturing of the multipurpose safety glove of the present disclosure including the breakaway portions 2, the incidence ratio of defective articles is significantly decreased, and the productivity can be greatly increased. In addition, since a portion or all of the water-soluble polymer dissolves in water at a certain temperature range, when the accident, such as the insertion of glove into a rotating machine, occurs at a work site, the breakaway portion 2 corresponding to a certain portion of the finger can be broken, so that the corresponding finger portion 1 is completely separated from the body portion 1 of the glove. Therefore, since the safety glove of the present disclosure is manufactured using the above water-soluble polymer, a glove having excellent ease of breaking can be produced. As a result, it is possible to prevent a workplace accident in which the entire part of the hand part is brought into contact with the mechanical device and is squeezed or cut off, due to the finger portion of the glove is getting entangled in the rotating machine or the like.

Particularly, the following Tables 1 and 3 show the examples of the present disclosure and the effects such as ease of operation, ease of breaking, and fraction defective. As can be seen from Tables 1 and 3, It can be seen that an excellent glove satisfying both ease of operation and ease of breaking can be produced by weaving the breakaway portion 2 by twisting the first yarn and the second yarn, with any one of polyvinyl alcohol (PVA), water-soluble acrylic (Acryl) polymer, polyethyleneimine (PEI) being selected as a water-soluble polymer.

On the other hand, the water-soluble polymer may have a melting point of 40 to 100° C., preferably 40 to 80° C., and more preferably 40 to 60° C. In this temperature range, the water-soluble polymer can be easily eluted into water, so that the water treatment is not performed at an excessively high temperature, and thus the process can be performed more easily. When the water-soluble polymer dissolves at a temperature lower than 40° C. it can also dissolve in water at room temperature, so that the process conditions may be more restrictive, and when it is dissolved in the range of more than 100° C., it may be difficult to carry out the water treatment step with higher temperature water.

Next, the step of twisting the second yarn containing a water-soluble and the first yarn polymer will be described.

A yarn (twisted yarn) in the step (1) may be used without restriction as long as it can be used for weaving conventional safety glove, but it may be a covering yarn produced by covering and twisting two or more yarns. The first yarn may be a primary yarn, the second yarn may be twisted as a covering composite yarn by covering the water-soluble polymer with the covering yarn, It is possible to obtain a glove satisfying both perforation resistance and elasticity when a multipurpose safety glove is woven using the above-mentioned twisted yarn.

When the glove of the present disclosure is woven using a composite yarn without using the twisted yarn, or woven with separating using two or more yarns, once the water-soluble polymer is eluted into the water in the elution step, the remaining fiber-forming component is too small, so that a breakaway portion 2 having excessively low in tensile strength is produced. Then, the breakaway portion 2 may be broken during the glove manufacturing process, thereby increasing the incidence ratio of the defective article and lowering the productivity. Therefore, the glove may be easily cut off even when performing a general work and the ease of operation may be decreased.

In addition, preferably the second yarn as the twisted yarn may be produced by twisting 2 to 5 strands of cover yarn of water-soluble polymer per each strand of the first yarn which is a primary yarn, more preferably, by twisting 3 to 4 strands of cover yarn of water-soluble polymer per each strand of the first yarn. When the number of the water-soluble polymer strands less than the number of the above-mentioned strands are twisted with the first yarn, the breakaway portion can be easily separated not only at the time of a danger but also at the time of performing a general operation, and the ease of operation can be decreased. In addition, when more water-soluble polymer strands than the above-mentioned number are twisted, there is a problem that the breakaway portion is not broken at the time of danger in the work site and the worker cannot be sufficiently protected.

On the other hand, in the case of the twisted yarn, the first yarn and the water-soluble polymer may be mixed in a weight ratio of 1:2 to 4, more preferably 1:2.5 to 3.5. In the above weight ratio, the second yarn used in the step of manufacturing the breakaway portion 2 of the safety glove of the present disclosure contains more water-soluble polymer than the first yarn. The manufacturing step of the breakaway portion 2 can be performed with a fiber having a higher fineness than the process step of manufacturing the breakaway portion 2 using only a single yarn having a low fineness, it is possible to carry out the manufacturing step of the breakaway portion 2 with a fiber having a higher fineness than the manufacturing step of the breakaway portion 2 using only a single yarn having a lower fineness. As a result, yarn breakages during the manufacturing process are deceased, and the breaking of finger portions 3 in the process of inserting the glove into the hand mold is also decreased, thereby decreasing defective products. As a result, when the breakaway portion 2 is woven using the second yarn which is twisted in the above-mentioned weight ratio, There is an excellent effect that the incidence of defective products is decreased and the productivity is increased.

In addition, even if the twisting is carried out at the above-mentioned weight ratio, a portion or all of the water-soluble polymer is eluted through the water treatment in the step (2), finally, only a small amount of fiber-forming component is left in the breakaway portion 2 as compared to the original second yarn, therefore there is an advantage that the breakaway portion 2 corresponding to a certain portion of the finger can be completely separated from the body portion 1 of the glove by the force pulling from the outside when an accident, such as the insertion of the glove into a rotating machine, occurs at a work site. As a result, when the manufacturing process of the present disclosure is performed in the above-mentioned weight ratio, it is possible to reduce the fraction defective, and at the same time, the manufactured glove has an ease of cutting.

When less water-soluble polymer is mixed less than a range of the above-mentioned weight ratio, the breakaway portion 2 is easily broken during the manufacturing process of the glove, and the fraction defective is increased, thereby the production speed may be slowed and the manufacturing cost may be increased. When less water-soluble polymer is mixed in a weight ratio greater than the range of the above-mentioned weight ratio, economical efficiency may be lowered and productivity may be decreased.

Next, eluting a portion or all of the water-soluble polymer by treating the twisted water-soluble polymer with water of step (2) will be described.

In order to elute a part or all of the water-soluble polymer, the water treatment in step (2) may be carried out at a water temperature of 40 to 70° C., more preferably, at 40 to 60° C. As described above, the water-soluble polymer may have a melting point of 40 to 70° C., more preferably 40 to 60° C. Accordingly, when the water treatment is carried out in the above-mentioned temperature range, it is possible to elute all or a portion of the water-soluble polymer more easily.

When the water treatment is carried out at a temperature lower than 40° C. the water-soluble polymer may not dissolve in water at all. When the water treatment is carried out at a temperature higher than 70° C. the process may become more complicated.

On the other hand, simultaneously with or after step (2), step (3) of coating a portion or all of the breakaway portion 2 can be further performed.

Step (3) may be performed simultaneously with or after step (2), the water-soluble polymer may be coated to allow the multipurpose safety glove to be used at the work site, either simultaneously with that a portion or all of the breakaway portion 2 is eluted, or later. The coating of step (3) may be carried out by any typical method of coating the glove without limitation so that it can be used at the work site, but it can be preferably carried out by a wet process. The coating by the wet process can be carried out preferably at a temperature of 40 to 120° C. more preferably at a temperature of 60° C. to 120° C., and more preferably at a temperature of 80° C. to 120° C.

The solvent of the coating solution used in the coating step can be typically used without limitation as long as the coating component can be dissolved. Preferably an aprotic solvent may be used, and more preferably DMF (Dimethylformamide), MMF (Monomethylformamide), and the like may be used. The coating component may preferably be at least one selected from among acrylonitrile butadiene rubber (NBR), polyurethane, latex, and silicone. The use the above various coating components removes the limitations of the field of use of the multipurpose safety glove of the present disclosure, so that the multipurpose safety glove can easily applied to various kinds of work. According to one embodiment, when performed an operation, such as a lathe or milling, which is in contact with a large amount of oil, acrylonitrile butadiene rubber (NBR) may be used as a coating component. When performing rough work, such as carpentry, latex may be used as a coating component. When precise work is required, polyurethane (PU) may be used as a coating component. In addition, for an operation requiring heat resistance, silicon may be used as a coating component.

In addition, the coating solution may contain 40 wt % of the coating component, and the remaining amount may be the same as the solvent. When the coating component is contained in the coating solution in an amount of less than 40 wt % or more than 40 wt %, the concentration of the desired coating component and the viscosity of the coating solution cannot be maintained, and the degree of coating becomes insignificant or excessive, it may be inconvenient to work while wearing gloves, and there is a problem that the ease of operation is inferior due to the lack of functions corresponding to the characteristics of each work site.

Furthermore, the multipurpose safety glove which can be embodied according to the present disclosure includes a body portion 1, a finger portion 3, and a breakaway portion 2 which connect the body portion 1 and the finger portions 3. The breakaway portions 2 can be broken by force pulling from the outside, with a tensile strength thereof being 20 to 40 N when measured according to the standard of KS K 0520. The tensile strength may be preferably 20 N to 35 N. and more preferably 25 N to 35 N.

Preferably, the tensile strength may be a tensile strength at a gripping distance of 30 mm to 70 mm and a tensile speed of 10 mm/min to 100 mm/min.

The finger portion 3 can be separated from the body portion 1 when the force pulling from the outside is 20 N or more, with reference to the above tensile strength range. When the force pulling from the outside is 40 N or more, the finger portion 3 can be completely separated from the body portion 1. Accordingly, when an accident such as the insertion of a glove into a rotating machine occurs at a work site, the breakaway portion 2 corresponding to a certain portion of the finger can be broken from the body portion 1, thereby preventing a workplace accident before the entire part of the hand of a worker is brought into the rotating machine and is squeezed or cut, due to the finger portion 3 being entangled in the machine or the like.

When the tensile strength of the breakaway portion 2 is less than 20N, the breakaway portion 2 of the glove can be broken not only at the time of a danger but also in a normal work process, there may be a problem in that the ease of operation is decreased. In addition, when the tensile strength of the breakaway portion 2 exceeds 40 N, the external force pulling the finger portion 3 needs to be larger. Thus, the breakaway portion 2 may not be broken in an accident in a work site, such as the insertion of the glove being brought into the rotating machine, there may be a problem that the ease of cutting and safety are decreased.

In addition, after the elution or coating step, the breakaway portion 2 of the safety glove may contain up to 10 wt % of a water-soluble polymer, preferably 5 wt % or less, more preferably 3 wt % or less, and most preferably, a water-soluble polymer may not be present. When the water-soluble polymer is present in an amount of more than 10 wt %, the water-soluble polymer present in the glove may be eluted when the water treatment is performed in the work site or when the work is performed under the condition in which water is present, there may be a problem that the ease of operation is decreased.

A method of manufacturing a multipurpose safety glove of the present disclosure and a multipurpose safety glove thereof, as described above, it is possible to have not only ease of cutting at the time of danger but also ease of operation, and the fraction defective in the production process is so low that the manufacturing cost can be reduced and productivity is high. The following Examples, Comparative Examples and Experimental Examples will be described in detail.

EXAMPLES

Hereinafter, Examples of a multipurpose safety glove according to the present disclosure and a method of manufacturing the same will be described in detail.

Examples 1 to 13

A body portion 1 and finger portions 3 were manufactured using a yarn satisfying a fiber type and a fineness represented in Table 1 below, and breakaway portions 2 were produced by twisting a first yarn of the Table 1 below and a second yarn satisfying the fiber type, fineness and weight ratio of water-soluble polymer.

The nylon yarn contained in the body portion 1 was inserted into the yarn introduction apparatus, and the body portion of the glove was knitted with the yarn using the knitting machine. Then, a nylon yarn or the first yarn, acting as a primary yarn, was twisted with a second yarn, as a covering yarn, by covering the nylon yarn polyvinyl alcohol, water-soluble polymer. The covering yarn was twisted by twisting three strands of the polyvinyl alcohol, the water-soluble polymer, per each strain of the nylon yarn, the primary yarn. After knitting the breakaway portions 2 with the twisted second yarn, the finger portions 3 of the glove were knitted with the nylon yarn, such as the body portion 1, by continuous knitting, thereby manufacturing the glove.

Next, knitted gloves were immersed in a coating solution, prepared by mixing 57 wt % of solvent and 43 wt % of acrylonitrile butadiene rubber (NBR), for several seconds at a temperature of 100° C. for coating.

TABLE 1

| | Body portion and Finger portion | | Twisted yarn contained in breakaway portion | | | | | |
|---|---|---|---|---|---|---|---|---|
| | | | First yarn | | Water-soluble polymer | | Weight ratio of | |
| | Fiber type | Fineness A (De) | Fiber type | Fineness B (De) | Fiber type | Fineness (De) | First yarn:Water-soluble polymer | A/B |
| Example 1 | Nylon | 800 | Nylon | 15 | Polyvinyl alcohol | 100 | 1:3 | 53.3 |
| Example 2 | Spandex | 630 | Spandex | 15 | Polyvinyl alcohol | 80 | 1:3 | 42 |
| Example 3 | Polyamide | 680 | Polyamide | 18 | Polyvinyl alcohol | 120 | 1:3 | 37.8 |
| Example 4 | Nylon | 930 | Nylon | 15 | Polyvinyl alcohol | 60 | 1:3 | 62 |
| Example 5 | Nylon | 660 | Nylon | 20 | Polyvinyl alcohol | 140 | 1:3 | 33 |
| Example 6 | Spandex | 1005 | Spandex | 15 | Polyvinyl alcohol | 40 | 1:3 | 67 |
| Example 7 | Polyamide | 540 | Polyamide | 20 | Polyvinyl alcohol | 160 | 1:3 | 27 |
| Example 8 | Nylon | 1080 | Nylon | 15 | Polyvinyl alcohol | 50 | 1:3 | 72 |
| Example 9 | Spandex | 800 | Spandex | 15 | Polyvinyl alcohol | 150 | 1:4 | 53.3 |
| Example 10 | Nylon | 800 | Nylon | 15 | Polyvinyl alcohol | 60 | 1:2 | 53.3 |
| Example 11 | Spandex | 800 | Spandex | 15 | Polyvinyl alcohol | 100 | 1:5 | 53.3 |
| Example 12 | Polyamide | 800 | Polyamide | 15 | Polyvinyl alcohol | 50 | 1:1 | 53.3 |
| Example 13 | Polyamide | 800 | Polyamide | 15 | Polyvinyl alcohol | 60 | 1:3 | 53.3 |
| Example 14 | Nylon | 800 | Nylon | 15 | Water-soluble polyester | 30 | 1:3 | 53.3 |

Comparative Example 1

A multipurpose safety glove was prepared by knitting the body portion 1, the finger portions 3 and the breakaway portions 2 with the nylon yarn having the same fineness, in the same manner as in Example 1, except that no water-soluble polymer was used, thus a covering yarn was not used, and the breakaway portions 2 were knitted thinner.

Comparative Example 2

A multipurpose safety glove was prepared by knitting the body portion 1, the finger portions 3 and the breakaway portions 2 with the nylon yarn having the fineness represented in Table 2 below, in the same manner as in Example 1, except that no water-soluble polymer was used, thus a covering yarn was not used, and the breakaway portions 2 were knitted thinner.

Comparative Example 3

A multipurpose safety glove was prepared in the same manner as in Example 1, except that an alkali-soluble polyester was used instead of the water-soluble polymer.

TABLE 2

| | Body portion and Finger portion | | Second yarn contained in breakaway portion | | | | | |
|---|---|---|---|---|---|---|---|---|
| | | | First yarn | | Polymer | | Weight ratio of | |
| | Fiber type | Fineness A (De) | Fiber type | Fineness B (De) | Fiber type | Fineness (De) | First yarn:Water-soluble polymer | A/B |
| Comparative Example 1 | Nylon | 800 | Nylon | 15 | — | — | — | — |
| Comparative Example 2 | Nylon | 800 | Nylon | 15 | x | — | — | 53.3 |
| Comparative Example 3 | Nylon | 800 | Nylon | 15 | Alkali-soluble polyester | 20 | 1:3 | 53.3 |

Experimental Example 1: Ease of Operation and Ease of Cutting

In the present experimental example, gloves manufactured by the above-described Examples and Comparative Examples were worn by 20 workers of or over 20 years of age, and then degrees of simultaneous satisfaction of the ease of operation and the ease of cutting were investigated. Scores of the ease of operation of the glove manufactured by each of Examples and Comparative Examples were measured by giving scores of 5 (very good), 4 (good), 3 (normal), 2 (poor), and 1 (very poor) according to the ease of work, respectively. In addition, when the finger portions 3 of the gloves were pulled for 5 seconds with a force of 30 N, the ease of breaking of the gloves produced by Examples and Comparative Examples were evaluated by giving scores of 5 (completely separated), 4 (50% separated), 3 (25% separated), or 0 (not separated at all) according to the degrees of separation of the breakaway portion 2 located at the knuckle portion of the glove from the circumference of the finger, respectively. In this case, ten gloves were manufactured for each of Examples and Comparative Examples, and scores were measured according to the above criteria. The average values of the scores are represented in Table 3 below, respectively.

Experimental Example 2: Ratios of Defective Articles (Fraction Defective) in Manufacturing In the present experimental example, the incidence ratios of the defective articles were measured by investigating 1000 multipurpose safety gloves manufactured by Examples and Comparative Examples. The results are represented in Table 3 below.

TABLE 3

| Classification | Ease of operation | Ease of cutting | Fraction defective (%) |
|---|---|---|---|
| Example 1 | 5 | 5 | 0.1 |
| Example 2 | 4.5 | 4.2 | 0.5 |
| Example 3 | 4 | 5 | 0.3 |
| Example 4 | 4.2 | 4.3 | 0.3 |
| Example 5 | 4.4 | 4 | 0.5 |
| Example 6 | 4 | 3.8 | 0.6 |
| Example 7 | 3.4 | 3.4 | 0.2 |
| Example 8 | 3 | 3.5 | 0.1 |
| Example 9 | 4.2 | 4.2 | 0.1 |
| Example 10 | 4 | 4.3 | 0.3 |
| Example 11 | 3.8 | 3.6 | 0.4 |
| Example 12 | 3.5 | 3.4 | 3 |

TABLE 3-continued

| Classification | Ease of operation | Ease of cutting | Fraction defective (%) |
|---|---|---|---|
| Example 13 | 4.8 | 4.6 | 2 |
| Example 14 | 4.4 | 4.6 | 2 |
| Comparative Example 1 | 1 | 2.8 | 91 |
| Comparative Example 2 | 1.5 | 3.2 | 89 |
| Comparative Example 3 | 2.2 | 1.5 | 50 |

As represented in Table 3 above, it can be appreciated that Examples 1 to 13 are superior to Comparative Examples 1 to 3 in ease of operation and ease of cutting and have a remarkably lower fraction defective compared to Comparative Examples 1 to 3.

Significantly, when the multipurpose safety gloves of Example 1 is compared with the multipurpose safety glove of Comparative Example 1 prepared using the nylon yarn having the same fineness, except that the breakaway portions 2 were knitted thinner than the body portion 1 or the finger portions 3, it can be appreciated that Example 1 exhibits excellent ease of operation as well as ease of breaking as compared with Comparative Example 1. In addition, the fraction defective of Example 1 is significantly lower than the fraction defective of Comparative Example 1, and thus it can be appreciated that Example 1 has excellent productivity.

In addition, when the multipurpose safety gloves of Example 1 is compared with the multipurpose safety gloves of Comparative Example 2 woven without using the water-soluble polymer contained in the breakaway portion 2 of the present disclosure, it may be appreciated that Example 1 is superior to Comparative Examples 2 in ease of operation and ease of cutting and has a fraction defective remarkably lower than Comparative Examples 2.

In addition, when the multipurpose safety gloves of Example 1 is compared with the multipurpose safety glove of Comparative Example 3 in which The breakaway portion 2 of the present disclosure was woven by twisting a first yarn with an alkali-soluble polyester in place of the water-soluble polymer, it can be appreciated that Example 1 exhibits excellent ease of operation as well as ease of cutting as compared with Comparative Example 3. In addition, it can be appreciated that the fraction defective of Example 1 is remarkably low.

Experimental Example 3: Measurement of Tensile Strength

In this Experimental Example, levels of tensile strength of the multipurpose safety gloves manufactured by the above Examples and Comparative Examples were measured according to the standard of KS K 0520. The tensile strengths of the knuckle portion of the finger portions 3 of the glove were measured, in which a gripping distance was 50 mm and a tensile speed was 50 mm/min.

TABLE 4

| Classification | Tensile strength (N) |
|---|---|
| Example 1 | 29.9 |
| Example 2 | 30.5 |
| Example 3 | 32 |
| Example 4 | 33.3 |
| Example 5 | 31.2 |
| Example 6 | 30.5 |
| Example 7 | 28.6 |
| Example 8 | 29.5 |
| Example 9 | 30.3 |
| Example 10 | 29.6 |
| Example 11 | 25.3 |
| Example 12 | 30.2 |
| Example 13 | 28.3 |
| Example 14 | 28.6 |
| Comparative Example 1 | 12.1 |
| Comparative Example 2 | 10.5 |
| Comparative Example 3 | 50.3 |

What is claimed is:

1. A method of manufacturing a multipurpose safety glove comprising a body portion, a finger portion, and a breakaway portion connecting the body portion to the finger portion and being separable by force pulling from the outside, the method comprising manufacturing the breakaway portion by:

twisting and weaving a first yarn insoluble in water and a second yarn comprising a water-soluble polymer; and eluting a portion or all of the water-soluble polymer by treating the twisted water-soluble polymer with water.

2. The method of claim 1, wherein an average fineness (A) of a fiber forming the body portion and the finger portion, and an average fineness (B) of the first yarn satisfy a following formula:

$$30 \leq A/B \leq 70.$$

3. The method of claim 1, wherein the water-soluble polymer comprises one selected from among polyvinyl alcohol (PVA), water-soluble acrylic polymer, polyethyleneimine (PEI), and water-soluble polyester.

4. The method of claim 1, wherein the water soluble polymer has a melting point of 40° C. to 100° C. in water and the treatment with water in the eluting of the water-soluble polymer is performed at a water temperature of 40° C. to 100° C.

5. The method of claim 1, wherein the first yarn comprises at least one selected from among nylon, spandex, polyamide, ultra-high molecular weight polyethylene (UHMWPE), polyolefin fiber, and polyester.

6. The method of claim 1, wherein, in the twisting of the first yarn and the second yarn, the first yarn and the water-soluble polymer are mixed in a weight ratio of 1:2 to 4.

7. The method of claim 1, further comprising coating a portion or all of the breakaway portion, simultaneously with or after eluting the water-soluble polymer.

8. A multipurpose safety glove comprising:

a body portion;

a finger portion; and a breakaway portion that connects the body portion with the finger portion and can be separated by a force pulled from the outside, wherein the breakaway portion comprises a first yarn insoluble in water, and wherein the breakaway portion has a tensile strength of 20 to 40 N when measured according to KS K 0520 standard, and satisfies a following formula:

$$30 \leq A/B \leq 70$$

wherein A denotes an average fineness of a fiber forming the body portion and the finger portion, and B denotes an average fineness of the first yarn.

* * * * *